US005109784A

United States Patent [19]

Lepe-Cisneros

[11] Patent Number: 5,109,784

[45] Date of Patent: May 5, 1992

[54] FLOOR MAT WITH VARIOUS TUFTING DENSITY ZONES

[76] Inventor: Marco A. Lepe-Cisneros, Calle 7th - #2209 Interior, Zona Central, Tijuana, B.C., Mexico

[21] Appl. No.: 633,072

[22] Filed: Dec. 24, 1990

[30] Foreign Application Priority Data

Dec. 28, 1989 [MX] Mexico ..... 18959/122600

[51] Int. Cl.[5] ..... D05C 15/00

[52] U.S. Cl. ..... 112/266.2; 112/80.70; 156/72; 428/88; 428/95

[58] Field of Search ..... 112/80.70, 80.23, 80.73, 112/80.01, 410, 7, 9, 121.16, 80.43, 80.44, 2.2, 266.1, 266.2; 29/121.1; 156/72, 71, 88; 26/30, 31; 428/85, 88, 89, 92, 95

[56] References Cited

U.S. PATENT DOCUMENTS

| | | | |
|---|---|---|---|
| 3,080,837 | 3/1963 | Kaffine et al. | 112/80.7 |
| 3,160,125 | 12/1964 | Bryant et al. | 112/80.7 X |
| 3,785,016 | 1/1974 | Hergert | 26/30 X |
| 3,870,583 | 3/1975 | Gidge | 29/121.1 X |
| 4,317,419 | 3/1982 | Spanel et al. | 112/266.2 |
| 4,650,454 | 3/1987 | Moll | 29/121.1 X |
| 4,686,918 | 8/1987 | Hjalmel et al. | 112/41 G |
| 4,743,330 | 5/1988 | Tillotson | 156/72 X |
| 4,808,459 | 2/1989 | Smith et al. | 156/72 X |
| 4,871,602 | 10/1989 | Luker | 428/88 |

FOREIGN PATENT DOCUMENTS

| | | | |
|---|---|---|---|
| 1135507 | 1/1985 | U.S.S.R. | 29/121.1 |

*Primary Examiner*—Werner H. Schroeder
*Assistant Examiner*—Paul C. Lewis
*Attorney, Agent, or Firm*—Henri J. A. Charmasson

[57] ABSTRACT

A floor mat and method of making same to be used in vehicles or as a passageway carpet that is characterized by having several areas of different tufting densities and thus of different resistances to wear. The method of the invention is accomplished by selectively feeding and non-feeding selected needles of a tufting machine of conventional construction. Machinery to bond the nap to the backing web and to apply a thermoplastic anti-skid lining is modified to accommodate the uneven napping densities and prevent irregular conveying of the carpet roll through the various processing stations.

15 Claims, 2 Drawing Sheets

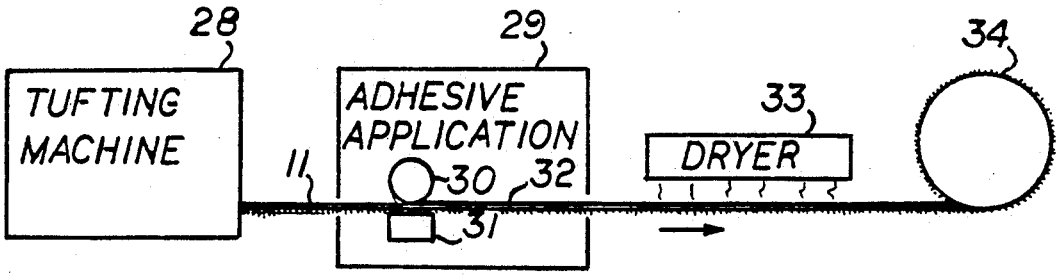
FIG. 5
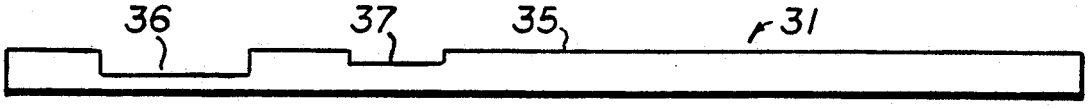
FIG. 6
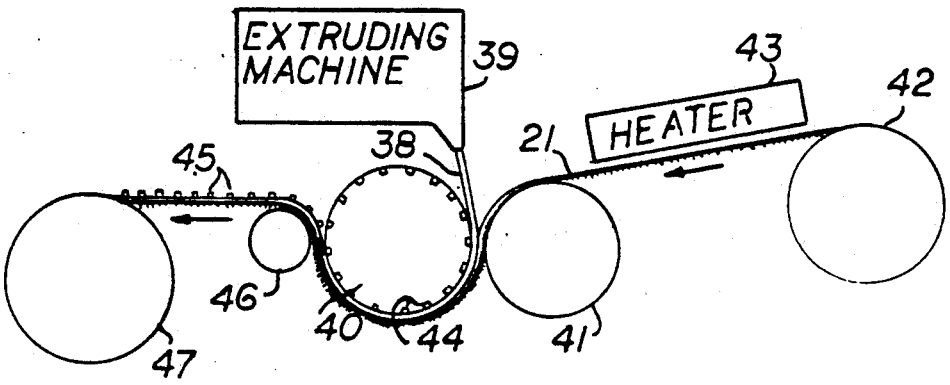
FIG. 7
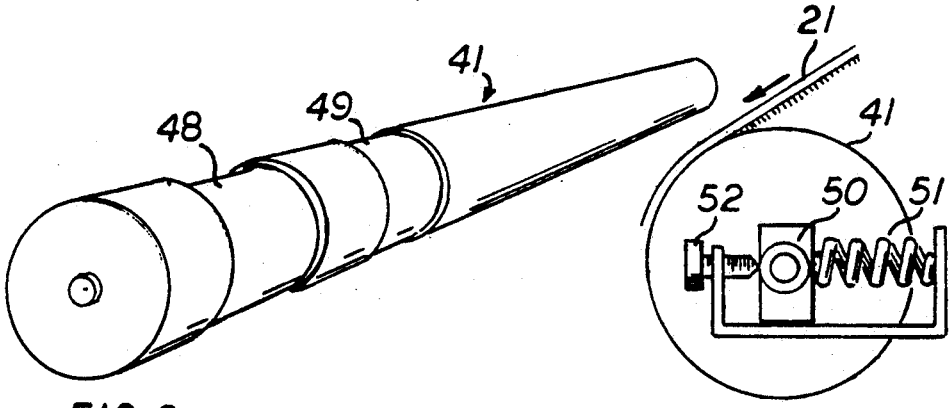
FIG. 8
FIG. 9

FLOOR MAT WITH VARIOUS TUFTING DENSITY ZONES

FIELD OF THE INVENTION

This invention is generally related to carpets. More particularly the invention is concerned with floor mats for cars or other types of vehicles that require zones of higher resistance to wear in the area disposed beneath the vehicle driver's feet, and with a new method for making this type of floor mat.

BACKGROUND OF THE INVENTION

It is widely known that mats used in cars experience uneven wear. That is, areas directly beneath the vehicle pedals are subject to greater wear than the salvage areas or other areas in the mat. Therefore, when homogeneous high resistance mats are manufactured, there is a costly great waste of material due to the fact that some areas of the carpet do not require such high resistance to wear. On the other hand, low resistance mats have a very short useful life due to excessive wear in some areas. Consequently, it is desirable to produce mats having zones of different densities.

There is also a need for mats having areas of different wear-resistances distributed in such a way that the areas of greater resistance to wear correspond to the areas subject to greater wear.

PRIOR ART

In order to solve the aforementioned problem, it has been proposed to attach reinforcing strips to carpets in the areas of highest wear. However, as reinforcements are not integral, they require a subsequent manufacturing stage to firmly adhere the reinforcements to the mat. This may adversely affect the appearance of the product. Another solution is set forth in U.S. Pat. No. 4,871,602 issued to Luker. This solution provides a mat having areas of different densities integrated to the carpet. Such a mat is produced by a method wherein two strands are fed to each of the tufting needles in one area thereby producing a double density, and feeding one strand to the tufting needles in other area thereby producing a single density. This method is inconvenient because it is not possible to readily obtain a wide range of tufting densities. It in only possible to obtain two different density zones. Furthermore, feeding multiple strands through a single conduction tube and then to a single needle, as has been suggested in the above patent can result in a erratic and unreliable yarn supply.

Conveying a roll of carpet-in-making having zones of different tufting densities through coating, drying, calendering and other processing equipment is fraught with many problems. For instance, when such a roll is passed by an adhesive-coating roller, the denser zones may receive less adhesive than the lesser density ones. When the roll is pulled through calendering rollers the high density zone may offer more resistance than the lighter density regions causing the roll to shift askew or to buckle along one side or the other. There is a lack of appropriate equipment to avoid or correct these problems.

SUMMARY OF THE INVENTION

The principal and secondary objects of the present invention are:

- to provide a floor mat having variable densities throughout for use on vehicle floors in the driver's area;
- to provide a method for making a floor mat having three or more areas of different densities and, consequently, of different resistances against wear. This method involves, essentially the use of a combination of spaced apart needles of a tufting machine which are selectively fed, or not fed with yarn;
- to provide a method for producing a car mat having areas of highest and lowest densities distributed in accordance with a geometry corresponding to areas of higher or lesser wear of the mat. More particularly, the mat will be made in such a way that areas subjected to little use will be formed of medium yarn density and areas of highest use and wear will be formed of maximum yarn density;
- to produce in a simple, continuous manner a carpet having three or more different densities in a continuous and very simple manner;
- to produce a mat which has a greater durability than comparable prior art floor mats;
- to give a mat zones of different wear resistance without adversely affecting its appearance;
- to manufacture in the same in-line process mats of having different tufting density zones, and mats of equal tufting density throughout; and
- to produce such mats at low cost and ease of manufacture.

It is also an object of the present invention to provide the equipment necessary to apply a thermoplastic backing to carpest and mats having different tufting density zones, and to conveniently convey rolls of the same through various processing machines.

These characteristics of the invention will become more apparent from the following description.

BRIEF DESCRIPTION OF THE DRAWINGS

FIG. 5 is a diagram of the tufting and bonding process;

FIG. 6 is a front profile of the bonding sole plate;

FIG. 7 is a diagram of the thermoplastic backing process;

FIG. 8 is a perspective of the calendering roller; and

FIG. 9 is a side view of the calendering roller pressure adjusting mechanism.

DESCRIPTION OF THE PREFERRED EMBODIMENT OF THE INVENTION

Figure 1:
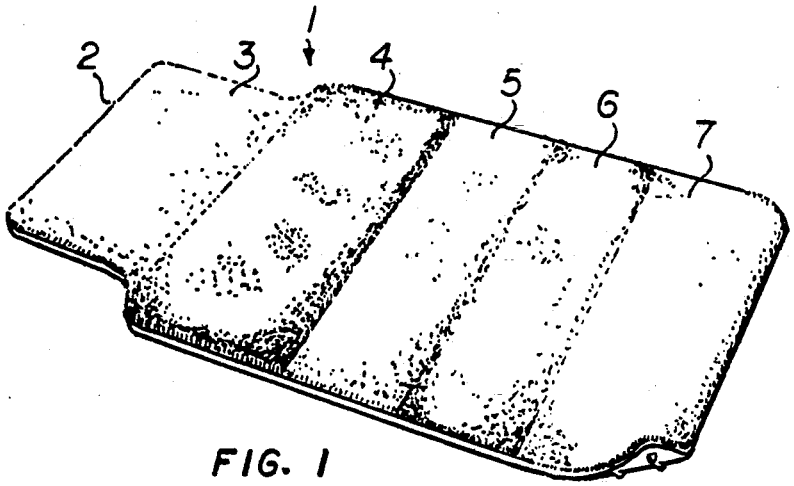
FIG. 1 is a generally perspective view of the vehicle mat of the present invention having sections with different tufting densities.

Referring now to the drawings beginning with FIG. 1, the mat 1 produced by the method of the present invention is shown. When the description herein refers to a mat having a special use for vehicles, this same mat has the characteristics required to be used with advantage in other types of applications such as in passageways or other places exposed to different wear in different sections of the carpet.

The character of the embodiment illustrated in FIG. 1 will be described first.

Starting at the narrowed upper edge 2 of the mat 1 there is a first zone 3 having 50% tufting density covering an area about 13 cm wide. This is the first density zone of the mat. Following the first zone, is a 100% tufting density, second zone 4 measuring approximately 21 cm in width. Approximately 34 cms from the upper edge 2, begins third zone 5 measuring about 13 cms, and having a 50% tufting density. Following the third zone is a fourth zone 6 measuring about 13 cms in width, with a 75% tufting density. Adjacent the fourth zone is another 50% density section which constitutes the last or fifth zone 7. The width of the fifth zone is determined in accordance with the design of the carpet and may measure 13 or more cms.

The pattern described, including the dimensions specified, may vary widely and should not be construed as limitations of this invention. In actual practice both pattern and dimensions will vary in accordance with the type, model and design of the vehicle within which the mat 1 is to be used, or in accordance with other types of applications requiring variable resistance, and where sections of different resistance require a different distribution.

In this particular embodiment of a vehicle floor mat 1 designed for placement under the driver's feet, the various zones 3–7 are located and dimensioned according to the expected wear. The second, highest density, zone 4 covers the area against which the heels of the driver rubs during activation of the brake clutch, and gas pedals. The fourth, medium density zone 6 corresponds to the area against which the heels and soles of the driver rest most often between periods of pedal activation and during adjustment of the seat position. The first, third and fifth zones 3, 5, 7 cover those areas of the vehicle floor subject to the least amount of wear and tear.

Figure 2:
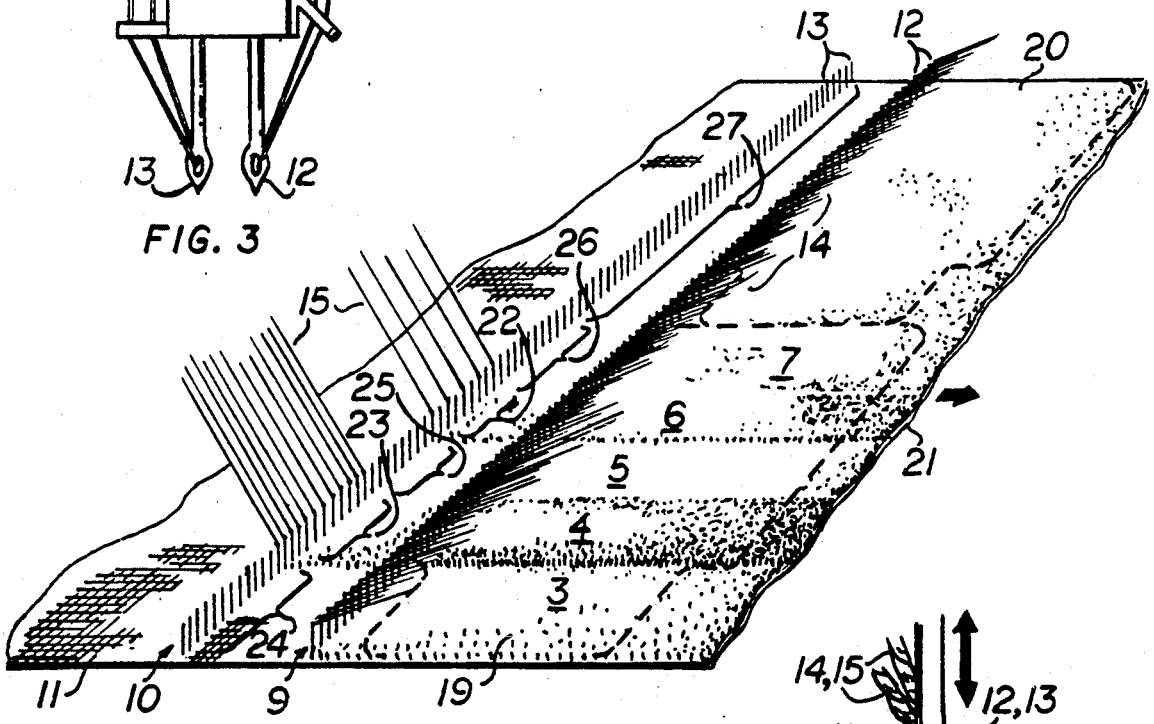
FIG. 2 is a diagrammatical perspective of the tufting process.

A method for manufacturing multiple tufting density floor mats and carpet will now be described. It should be understood at the outset that the carpet is woven by means of a conventional tufting apparatus in a very economical manner. No modification of the distances between the needles of the tufting machine is required and no feeding of double strands in one needle or of strands of higher caliber in one needle or another is necessary. Rather, the unique density variation of the carpeet of the invention is achieved by the selective feeding of individual strands of yarn of a desired gauge to selected needles of a double row needle bar of a conventional, high density tufting machine. As illustrated in FIG. 2, the tufting machine 8, which is well known to those skilled in the art, includes front and back generally parallel rows 9, 10 of equally spaced tufting needles that extend across the width of the backing 11 and reciprocate vertically as the backing passes beneath the needles.

Figure 3:
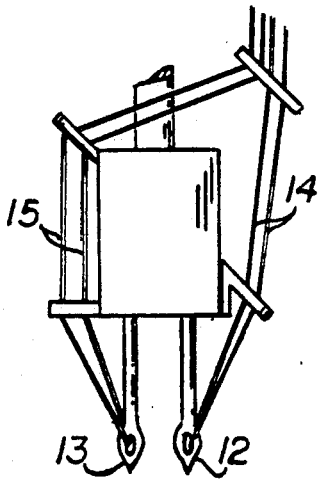
FIG. 3 is a side view of a dual needle bar of a tufting machine.
Figure 4:
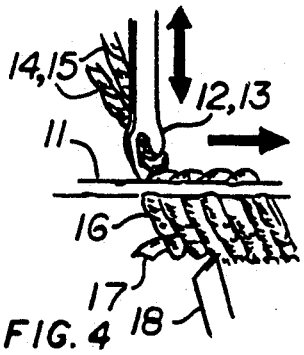
FIG. 4 is a side view of a needle tufting operation.

As more specifically shown in FIGS. 3 and 4, each needle 12 of the front row 9 and each needle 13 of the back row 10 are normally and continuously fed with yarns 14 and 15. As each needle 12, 13 reciprocates through the backing web 11 it forms loops 16 of yarn which are engaged by a hook 17, then cut by a knife 18. Various zones of different tufting density can be created transversally across the full width of the backing web 11 by selectively omitting to feed yarns to some groups or sets of sequential needles within one of the rows 9, 10.

In the diagram of FIG. 2 which represents a conventional tufting machine, the width of the backing web 11 is sufficient to accommodate the length of two floor mats 19, 20. Accordingly, in the continuous tufting process two floor mats 19, 20, outlined in phantom lines, whose positions are longitudinally aligned across the width of the manufactured carpet strip 21 are simultaneously tufted by the two rows 9, 10 of needles. While all the needles 12 of the front row 9 are fed yarn, the process according to the invention calls for selectively omitting to feed yarns to some of the needles 13 in the second row 10. More specifically, in order to obtain a 75% tufting density over the fourth zone 6 of the left mat 19, yarns are fed to only every other one of a first set 22 of needles of the second row 10. In order to obtain a 100% tufting density in the second zone 4 of the mat, all the needles of a second set 23 are continuously fed yarn. A third set 24, fourth set 25, and fifth set 26 of needles of the back row, as well as the entire right half 27 of the second row of needles are never fed any yarn. The latter set corresponds to the 50% tufting density zones 3, 5 and 7 of the mat coming out of the left half of the carpet 21 and to all the mats cut out from the right half of the same carpet roll. The right side mats 20 which have a constant low tufting density are designed to be used on the passenger side of an automobile. In an alternate arrangement, the pattern of yarn feeding applied to the left half of the second row 10 of needles could be repeated over the right half in order to produce two mats having different tufting density zones simultaneously.

One of the many advantages offered by the method of the present invention is that no modification of the conventional tufting machine is required. Further, it is not necessary to feed two or more strands of yarn to a single needle which tends to overburden the cutting system of the tufting equipment and undesirably slows the feeding process.

It should also be appreciated that in the practice of the method of the present invention, special orders of strands of different caliber are not required to vary the density of the end product. Furthermore, the variable density of the product being integrated with the same type of strands, produces a carpet having the same quality and durability as a product manufactured in a conventional manner using a high density tufting machine.

The equipment necessary to bond the nap of the multiple tufting density zone carpet 21 is illustrated in FIGS. 5 and 6. After the carpet 21 exits the tufting machine 28 it is pulled through an adhesive application station 29. In that station, carpet 21 passes between an adhesive distributing stationary roller 30 and a sole 31. The roller 30 applies a layer of adhesive 32 to the backing web 11. The adhesive is selected to be compatible with the thermoplastic compound which will be affixed later to the carpet. The viscosity of the adhesive must be such that it will penetrate the roots of the strands and securely bond them to the web 11. The carpet is then passed by a drying station 33, or alternately through an oven, before it is wound over a takeup roller 34. As illustrated in FIG. 6, the face 35 of the sole 31 in contact with the nap of the carpet 21 has a series of depressions 36, 37 corresponding to the high and medium density zones 4, 6 of the nap. The depressed area 36, 37 which accommodates the less compressible zone of the carpet helps to maintain the backing 11 flat, thus assuring an even distribution of adhesive over the entire width of the web. Without the depressions 36, 37 the high density zones of the carpet would encounter more resistance in passing through the adhesive applying station 29, this may cause the strip of carpet 21 to shift to an askew position as a result of the difference in resistance between the left and right halves of the carpet. The uneven friction through the adhesive applying station 29 may also cause buckling on one side of the carpet strip, which in turn would result in uneven application and penetration of the adhesive.

It should be noticed that the depression 36 corresponding to the 100% tufting zone is deeper than the depression 37 corresponding to the 75% density zone of the carpet.

The application of a thermoplastic, anti-skid backing to the multiple tufting density carpet is illustrated diagrammatically in FIG. 7. A sheet 38 of thermoplastic is produced by an extruding machine 39 and fed along with the strip of carpet 21 between two calendering rollers 40, 41. The strip of carpet 21 which is drawn from the feeding roller 42 is first passed by a heater 43 which mollifies the adhesive applied to the backing web 11. The calendering roller 40 which contacts the sheet of still warm and malleable thermoplastic 38 has its calendering surface etched in a plurality of small cavities 44. These cavities are intended to mold a pattern of anti-skid nibs 45 in the back of the floor mats. This roller 44 is maintained at a low temperature to cool and solidify the thermoplastic coating. The guiding roller 46 forces the thermoplastically backed carpet to remain in contact with the cooling roller 40 long enough to assure a complete solidification of the thermoplastic backing, before the carpet roll is wound on the takeup roller 47. In order to assure an even pressure across the full width of the carpet 21 during the calendering process, the surface of the second calendering roller 41 as shown in FIG. 8, is embossed with a profile substantially similar to the profile of the sole illustrated in FIG. 6. Basically, the depressed area 48, 49 corresponds to the high and medium tufting density zones respectively of the carpet. This configuration of the roller 41, just like that of the sole 31 assures an even progress of the carpet roll 21 through the machinery. The calendering pressure applied by the rollers 40, 41 is regulated and adjusted by the mechanism illustrated in FIG. 9. Each of the bearings 50 of the second calendering roller 41 has a certain amount of lateral play which is resiliently regulated by a spring 51 on one side, and adjustably limited on the opposite side by an adjusting screw stop 51. By compressing, the spring 51 can accommodate small variations in the thickness of the carpet or thermoplastic sheet 38. The screw top 52 sets the minimum calendering spacing between the two rollers 40 and 41.

While the preferred embodiments of the invention have been described, modifications can be made and other embodiments may be devised without departing from the spirit of the invention and the scope of the appended claims.

What is claimed is:

1. A method for manufacturing a roll of carpet having a transversally varied tufting density using a tufting machine having parallel, front and back transversal rows of symmetrically space-apart needles said rows of needles being alternately reciprocated through a carpet backing web, said method comprising:

threading yarns through all the needles of a first one of said rows and continuously feeding said yarns to said needles; and omitting to thread yarn through selected numbers of needles of a second of said rows.

2. The method of claim 1, which comprises continuously omitting to thread yarn through a selected number of needles of a first continuous set of needles in said second row.

3. The method of claim 2, which comprises threading yarn through and continuously feeding yarn to all the needles of a second continuous set of needles in said second row.

4. The method of claim 3, which comprises omitting threading any yarn through a third continuous set of needles in said second row.

5. The method of claim 4, which comprises continuously omitting to thread yarn through every other needle of said first continuous set.

6. The method of claim 5, which comprises continuously omitting to thread yarn through a fourth continuous set of needles in said second row.

7. The method of claim 6, wherein said third and fourth sets are adjacent to opposite ends of said second row.

8. The method of claim 7, which further comprises continuously omitting to thread yarn through a fifth continuous set of needles in said second row.

9. The method of claim 8, wherein said second set is interposed between said third and fifth sets.

10. The method of claim 9, wherein said third set is substantially equal to two thirds of said second set; and the first, third and fifth sets are of substantially equal length.

11. The method of claim 10, wherein each of said rows of needles span a length of at least 70 centimeters.

12. The method of claim 6, which comprises continuously omitting to thread yarn through a set of needles spanning one half of said second row.

13. The method of claim 11 which further comprises conveying said roll of carpet through an adhesive applying machine comprising a carpet supporting sole having patterned surface shaped and sized to accommodate said transversally varied tufting density.

14. The method of claim 13 which further comprises applying a thermoplastic backing to said roll of carpet.

15. The method of claim 14, wherein said step of applying comprises compressing said roll of carpet and thermoplastic backing together by means of a roller having a patterned surface shaped and sized to accommodate said transversaly varied tufting density.

* * * * *